United States Patent [19]

Legg et al.

[11] Patent Number: 4,553,364

[45] Date of Patent: Nov. 19, 1985

[54] WINDOW SASH AND FRAME MOLDED OF FIBROUS MATERIAL

[75] Inventors: Wesley E. Legg, Bexley; Russell L. Ault, Newark; Richard A. Mott, Alexandria; Alan R. Leewood, Newark, all of Ohio

[73] Assignee: Owens-Corning Fiberglas Corporation, Toledo, Ohio

[21] Appl. No.: 672,851

[22] Filed: Nov. 19, 1984

Related U.S. Application Data

[63] Continuation of Ser. No. 452,665, Dec. 23, 1982.

[51] Int. Cl.[4] ..... E04C 1/00

[52] U.S. Cl. ..... 52/309.13; 52/309.2; 52/787; 52/204; 49/DIG. 2

[58] Field of Search ..... 52/787, 204

[56] References Cited

U.S. PATENT DOCUMENTS

| | | | |
|---|---|---|---|
| 1,867,575 | 7/1932 | Loetscher . | |
| 2,817,619 | 12/1957 | Bichel et al. | 52/DIG. 7 X |
| 3,220,062 | 11/1965 | Hermann | 52/309.1 X |
| 3,328,086 | 6/1967 | Johnston . | |
| 3,403,488 | 10/1968 | Davidson et al. | 52/204 |
| 3,498,001 | 3/1970 | MacDonald | 52/309.2 X |
| 4,169,180 | 9/1979 | McDonagh | 52/DIG. 7 X |
| 4,224,774 | 9/1980 | Petersen | 52/DIG. 7 X |
| 4,433,517 | 2/1984 | Moore, Jr. | 52/204 |

*Primary Examiner*—Carl D. Friedman

*Attorney, Agent, or Firm*—Ronald C. Hudgens; Ted C. Gillespie; Paul J. Rose

[57] ABSTRACT

Window frames and sashes are molded of fabricated fibrous wool impregnated with a binder and coated with a resin which soaks into the surface to form a strong protective skin.

6 Claims, 2 Drawing Figures

WINDOW SASH AND FRAME MOLDED OF FIBROUS MATERIAL

This is a continuation of application Ser. No. 452,665 filed Dec. 23, 1982.

TECHNICAL FIELD

This invention relates generally to window sashes and frames, and more particularly to molded fibrous window sashes and frames.

BACKGROUND ART

Up to one-third of a building's heat is lost through windows. Double and triple glass panes are now frequently specified to combat this heat loss. Many manufacturers are attempting to increase the "R" value (resistance to heat conduction) in their window frames and mullions. Some metal window frames are now fabricated with thermal breaks, or gaps between opposed metal frame components, to reduce heat conduction as well as condensation on the room side of the frame. Wood window frames are also being specially designed to reduce heat loss and condensation. Wood is not as dimensionally stable as metal and it can dry out and warp. This can produce cracks allowing air infiltration and heat loss.

DISCLOSURE OF INVENTION

In accordance with the invention, window frames and sashes are made of molded fibrous material impregnated with a binder. Mineral, rock, or glass fibers can be used for the fibrous material, although glass fibers are preferred.

BRIEF DESCRIPTION OF DRAWINGS

The invention is hereinafter described in greater detail with reference to the accompanying drawings in which.

BEST MODE OF CARRYING OUT THE INVENTION

Figure 1:
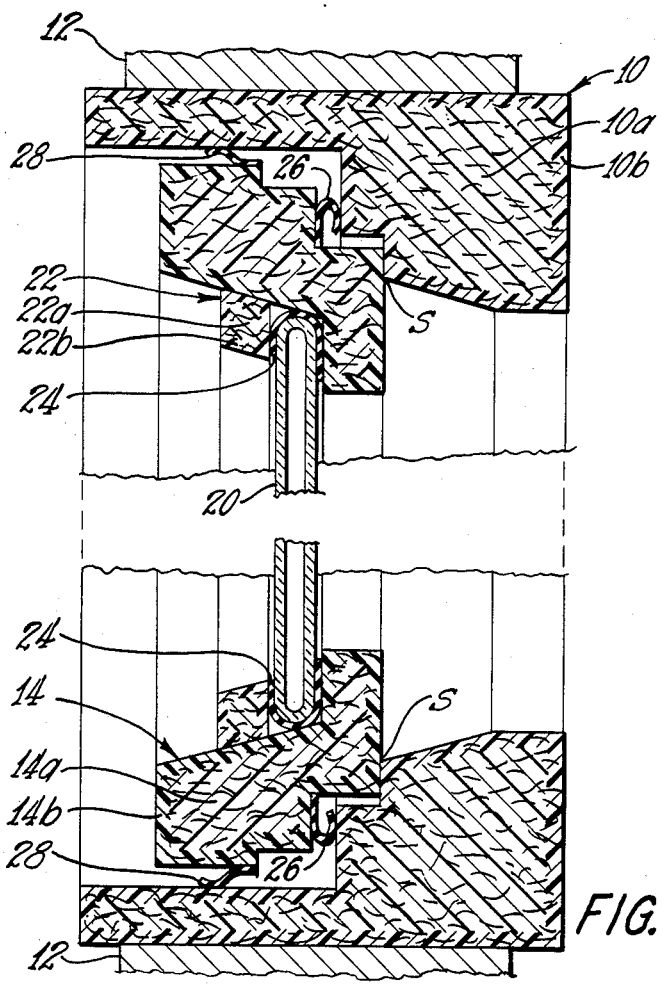
FIG. 1 is a fragmentary vertical sectional view of a window frame and casement.
Figure 2:
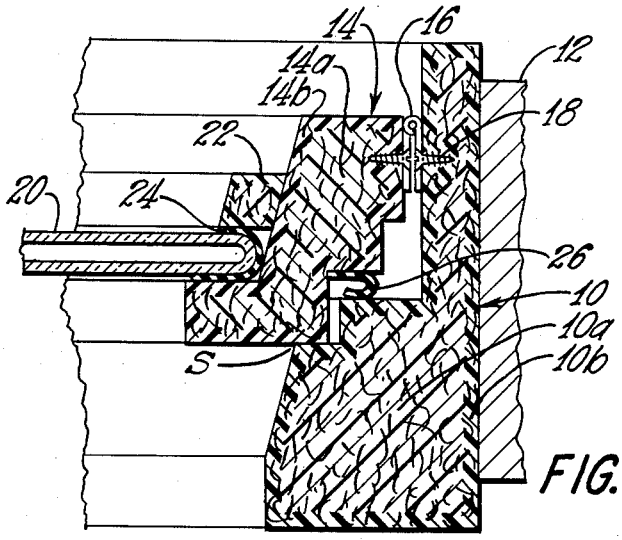
FIG. 2 is a fragmentary horizontal sectional view of the window frame and casement of FIG. 1.

With reference to the drawings, a rectangular window frame 10 is shown mounted in a wall 12. A rectangular casement 14 is pivotally mounted on a vertical side portion of the frame 10 by means of a pair of vertically spaced hinges 16, one of which is shown in FIG. 2. Cooperative portions of each hinge 16 are secured respectively to the frame 10 and the casement 14 by suitable fasteners such as screws 18. Rectangular insulating glass 20 is secured in the casement 14 by a rectangular retaining member 22 adhesively secured in place. The insulating glass 20 is two spaced panes of glass sealed together at their edges. Elastomeric sealing strips 24 are provided along the four edges of the insulating glass 20.

The frame 10 is provided with a double-stepped inner periphery and the casement 14 is provided with a double-stepped outer periphery. There is thus provided respectively on the frame 10 and on the casement 14 a first pair of cooperable surfaces extending parallel to the insulating glass 20 and forming a stop in the closing movement of the casement 14, as at points marked "S", and a second pair of cooperable surfaces extending parallel to the insulating glass 20, but spaced from each other in the closed position of the casement 14 to enable reception of elastomeric sealing strips 26 therebetween, the sealing strips 26 being adhesively secured to the casement 14 along all four sides. In addition, elastomeric sealing strips 28 are adhesively secured to the casement 14 along all four sides, except at the hinges on the hinged side, being attached along the largest outer periphery for cooperation with the largest inner periphery of the frame 10. Conventional hardware for opening and closing the casement 14 is not shown.

The frame 10, casement 14, and retainer 22 are molded from fabricated fibrous material, prefereably glass wool impregnated with about 20% by weight of a phenolic resin binder such as phenol-urea-formaldehyde. A density within the range of 6 to 20 and preferably of about 13 pounds per cubic foot has been found to be satisfactory for the molded glass wool. Top, bottom, and side pieces are cut to length, mitered or dove-tailed at opposite ends for later assembly, and saturated with polyester resin either before or after assembly. The polyester resin may be applied by brushing, spraying, or dipping, but better control and uniformity are possible by injection under pressure in a mold or die. In the drawings, the molded wool cores of the frame 10, casement 14, and retainer 22 are identified respectively by notations 10*a*, 14*a*, and 22*a*, while the polyester resin saturated outer skins are identified respectively by the notations 10*b*, 14*b*, and 22*b*. The application of the polyester resin causes no change in dimensions, because the polyester resin soaks into the molded wool, creating a strong, protective skin wherein the wool reinforces the polyester resin. In areas which are to receive screws such as the screws 18, holes are drilled before the polyester resin is applied, whereby the polyester resin can penetrate the screw receiving holes and form a good anchor for the screws.

Each top, bottom, or side piece of the casement 14 may be molded integrally with the corresponding piece of the retaining member 22. Further, each top, bottom, or side piece of the frame 10 or of the casement 14 may be made of two or more molded pieces adhered together before application of the polyester resin, or may be machined out of previously molded boards before application of the polyester resin.

The frame 10 and the casement 14 inclusive of the retaining member 22 may be finished in any suitable manner, such as covering with a pigmented gel-coat, painting, or cladding in metal or vinyl.

Some advantages of the molded glass or mineral wool construction are low cost compared to high quality wood, moldability to various shapes, high thermal resistivity, dimensional stability, rot and moisture resistivity, and less condensation on the window frame inside a house in cold weather.

The invention is equally applicable to other types of windows such as double-hung windows with sliding sashes. Various modifications may be made in the structure shown and described without departing from the spirit and scope of the invention as set forth in the following claims:

We claim:

1. A window comprising a generally rectangular frame and a generally rectangular sash therein, the frame and sash each having straight top, bottom, and opposite side members, each of said members being made of glass wool impregnated with a binder, the binder-impregnated glass wool having a density of less than twenty pounds per cubic foot, each of said members having resin in addition to the binder incorporated in outer surface portions thereof and completely around its cross-sectional periphery, and each of said members being visually solid in cross section.

2. A window as claimed in claim 1 wherein at least one member of the sash has blind holes, for the reception of screws, provided therein at desired locations after assembly of the respective top, bottom, and opposite side members into the sash and the portions thereof defining the blind holes have resin therein in addition to the binder to provide secure anchoring respectively for the screws.

3. A window as claimed in claim 1 wherein said resin in outer surface portions of each of said members is injected under pressure.

4. A generally rectangular window sash comprising straight top, bottom, and opposite side members, each of said members being made of glass wool impregnated with a binder, the binder-impregnated glass wool having a density of less than twenty pounds per cubic foot, each of said members having resin in addition to the binder incorporated in outer surface portions thereof and completely around its cross-sectional periphery, and each of said members being visually solid in cross section.

5. A window sash as claimed in claim 4 wherein at least one of the members has blind holes, for the reception of screws, provided therein at desired locations after assembly of the top, bottom, and opposite side members into the sash and the portions thereof defining the blind holes have resin therein in addition to the binder to provide secure anchoring respectively for the screws.

6. A window sash as claimed in claim 4 wherein said resin in outer surface portions of each of said members is injected under pressure.

* * * * *